US005893244A

United States Patent [19]

Magoon

[11] Patent Number: 5,893,244

[45] Date of Patent: Apr. 13, 1999

[54] SELF-SEALING FRAMING SYSTEM FOR BUILDINGS

[75] Inventor: Robert Dean Magoon, Duluth, Ga.

[73] Assignee: Kawneer Company, Inc., Norcross, Ga.

[21] Appl. No.: 08/786,553

[22] Filed: Jan. 21, 1997

[51] Int. Cl.[6] ..... E04H 1/00; E04H 3/00; E04H 5/00; E04H 6/00

[52] U.S. Cl. ..... 52/235; 52/730.1; 52/730.3; 52/797.1; 52/716.1; 52/716.2

[58] Field of Search ..... 52/235, 730.1, 52/730.3, 797.1, 798.1, 745.1, 745.15, 204.53, 716.2, 716.6

[56] References Cited

U.S. PATENT DOCUMENTS

| | | | |
|---|---|---|---|
| 4,896,473 | 1/1990 | Liebetrau | 52/235 X |
| 5,253,459 | 10/1993 | Parinas et al. | 52/235 |
| 5,309,689 | 5/1994 | Croissant | 52/235 |
| 5,481,839 | 1/1996 | Lang et al. | 52/235 |
| 5,592,795 | 1/1997 | Rinehart et al. | 52/235 |

*Primary Examiner*—Carl D. Friedman
*Assistant Examiner*—W. Glenn Edwards
*Attorney, Agent, or Firm*—Jones & Askew, LLP

[57] ABSTRACT

A self-sealing framing system is disclosed for curtainwalls, storefronts, and other framing systems for buildings in which frame members are erected in a grid and infill panels set within the openings of the grid. An elastomeric weathering gasket is mounted to a first frame member such that a portion of the weathering gasket overlies a recess formed in a side wall of the frame member. In an undeformed condition the elastomeric weathering gasket normally extends through a plane defined by the side wall of the first frame member. A second frame member oriented substantially perpendicular to the first frame member has an end abutting the side wall of the first frame member. The end of the second frame member contacts the elastomeric weathering gasket and displaces it onto one side of the plane by the contact with the end of the second frame member. A portion of the weathering gasket is displaced into the recess in the side wall of the first frame member. The weathering gasket thus forms a continuous seal between the first and second frame members along the line of contact with the second frame member.

6 Claims, 5 Drawing Sheets

Fig. 8
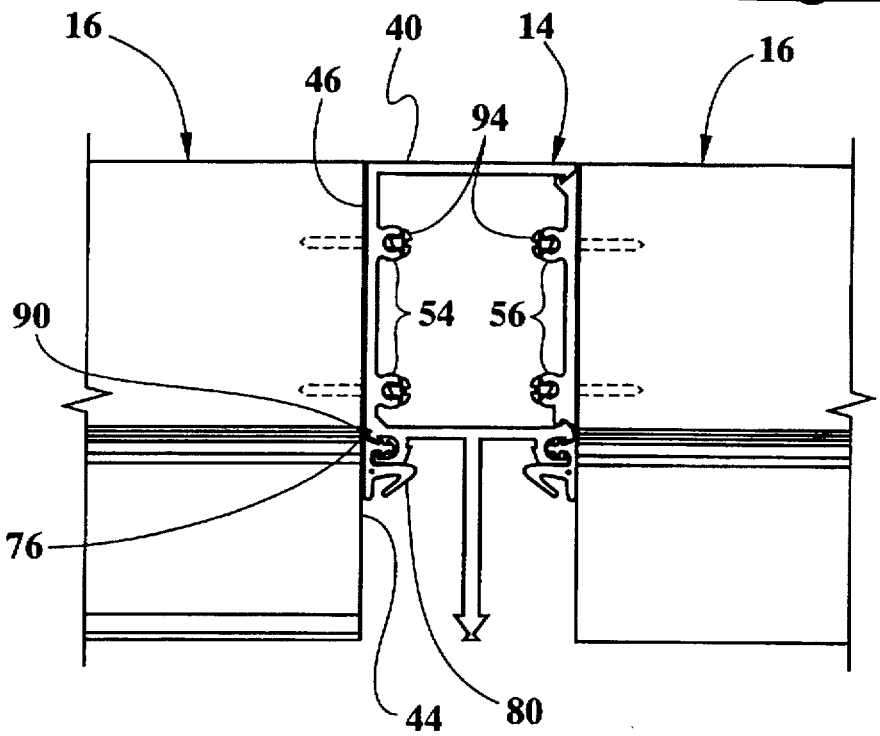
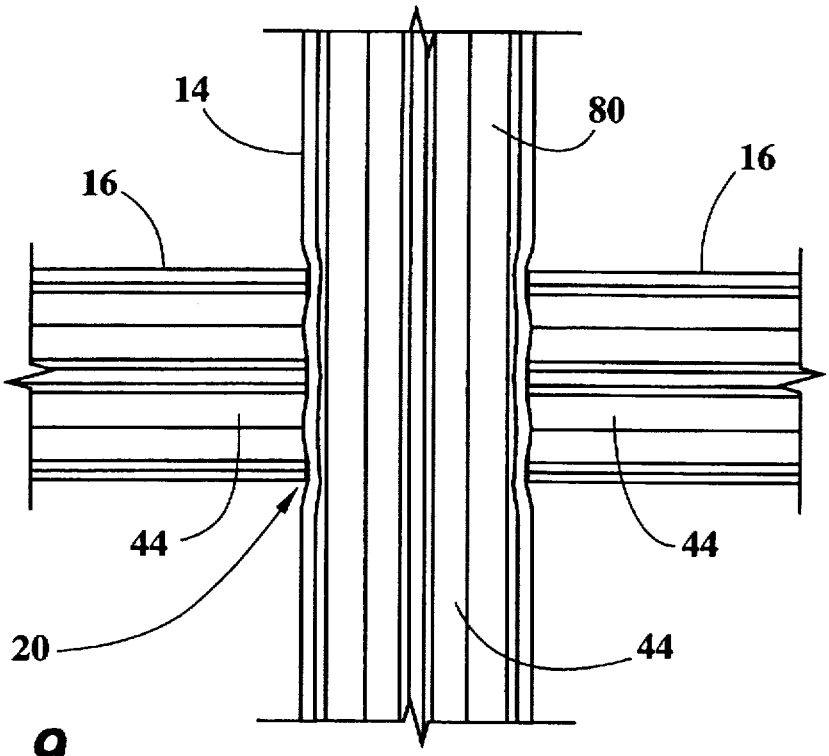
Fig. 9

SELF-SEALING FRAMING SYSTEM FOR BUILDINGS

TECHNICAL FIELD

The present invention relates generally to framing systems for buildings, and relates more specifically to a weathering system for preventing the infiltration of water from the exterior of a building into the interior through a joint formed by adjoining frame members.

BACKGROUND OF THE INVENTION

Storefront and curtain wall framing systems are well known wherein a grid of frame members is erected and infill panels set into the openings in the grid. In a typical storefront or curtain wall framing system, the vertical frame members or mullions are typically continuous from the sill to the head, while the intermediate horizontal frame members or muntins extend only between adjacent vertical frame members and abut the adjacent vertical frame members at each end. The vertical frame members thus extend through the joints with the intermediate horizontals and are thus sometimes referred to as "through" frame members. The vertical frame member is usually the through frame member because of the load-bearing requirements placed on the verticals. However, some storefront and curtain wall framing systems employ horizontal through members in conjunction with vertical intermediate frame members.

Elastomeric weathering strips are typically applied along the vertical and horizontal frame members and bear against the marginal portions of the infill panel. While the through frame members extend through the joint with abutting intermediate frame members, the weathering strips which are applied to the through frame members do not extend through the joint. Instead, the weathering strips applied to the through mullions are cut to length to fit between adjacent intermediate mullions.

Storefront and curtain wall framing systems are typically internally drained. That is, moisture which collects on an upper surface of a horizontal frame member flows along that horizontal surface until it reaches the adjoining vertical frame member, where the water is drained into a cavity defined by the vertical frame member. The water then runs down along the vertical frame member to the bottom of the framing system, where it is discharged from the building.

As the water flows from the horizontal frame member to the vertical frame member, it flows past the metal-to-metal joint between the through frame member and the abutting intermediate frame member. If there is a pressure differential between the interior and the exterior of the building, such as would be the case when the building is under wind load, water can be drawn between the through frame member and the end of the abutting frame member to the interior of the building. To prevent water and air infiltration through this metal-to-metal joint, it is necessary to seal the joint.

Such joints are typically sealed by applying a sealant to the joint after the frame members have been assembled. However, there are numerous disadvantages associated with this type of sealing arrangement. First, "wetsealing" the joint is labor intensive, both in terms of application of the sealant and subsequent clean up. And if the sealant is applied by unskilled or careless labor, it is possible for the joint to leak. Also, it is not practical to apply the sealant prior to erection of the framing system. While it is common for the vertical and horizontal frame members to be assembled into a grid prior to being shipped to the job site, racking or twisting of the grid during shipment for installation could disrupt any joint seal created by applying a sealant to the joint prior to shipping the framing system to the job site.

Thus there is a need for a system for sealing a joint between a through frame member and an abutting intermediate frame member which is not labor intensive to apply. There is a further need for sealing a joint between a through frame member and an abutting intermediate frame member which avoids the problem of defective joint seals caused by misapplication of a sealant at the job site by unskilled or careless labor.

There is still a further need for sealing a joint between a through frame member and an abutting intermediate frame member in which the seal can be applied prior to shipping the framing system to the job site.

SUMMARY OF THE INVENTION

Stated generally, the present invention comprises a weathering system for storefront and curtain wall framing systems which addresses these and other shortcomings associated with prior art weathering systems. The present invention comprises a framing system for storefronts and curtain walls wherein the framing system is self-sealing, that is, the act of assembling the frame members and associated gaskets will automatically seal the joints between through frame members and abutting intermediate frame members. The weathering of the disclosed framing system is not labor intensive to apply. Further, the problem of defective joint seals caused by misapplication of a sealant at the job site by unskilled or careless labor is eliminated. Finally, the weathering can be applied prior to shipping the framing system to the job site, and racking or twisting the framing system during shipment or installation will not adversely affect the sealing capacity of the weathering.

Stated somewhat more specifically, the present invention relates to a framing system for curtainwalls, storefronts, and other framing systems in which frame members are erected in a grid and infill panels set within the openings of the grid. An elastomeric weathering gasket is mounted to a first frame member such that a portion of the weathering gasket overlies a recess formed in a side wall of the frame member. In an undeformed condition the elastomeric weathering gasket normally extends through a plane defined by the side wall of the first frame member. A second frame member oriented substantially perpendicular to the first frame member has an end abutting the side wall of the first frame member. The end of the second frame member contacts the elastomeric weathering gasket along a line of contact, along which the weathering gasket is displaced onto one side of the plane by the contact with the end of the second frame member. A portion of the weathering gasket is displaced into the recess in the side wall of the first frame member. The weathering gasket thus forms a continuous seal between the first and second frame members along the line of contact with the second frame member.

Thus it is an object of the present invention to provide an improved building framing system for storefronts and curtain walls.

It is another object of the present invention to provide an improved weathering system for storefront and curtain wall framing systems.

Another object of the present invention is to provide a weathering system for storefront and curtain wall framing systems which reduces the amount of labor needed to weatherseal the framing system.

Still another object of the present invention is to provide a weathering system for storefront and curtain wall framing systems which reduces the possibility that the weatherseal will be improperly applied.

It is still another object of the present invention to provide a weathering system for storefront and curtain wall framing systems.

Still another object of the present invention is to provide a weathering system for storefront and curtain wall framing systems which can be applied prior to shipping the framing system to the job site.

It is another object of the present invention to provide a weathering system for storefront and curtain wall framing systems in which the weatherseal will not be disrupted if the framing system is racked or twisted during shipping or installation.

Other objects, features, and advantages of the present invention will become apparent upon reading the following specification, when taken in conjunction with the drawings and the appended claims.

BRIEF DESCRIPTION OF THE DRAWINGS

FIG. 8 is a cross-sectional view taken along line 8—8 of FIG. 1.

FIG. 9 is an elevation view of a joint identified by the rectangle A in FIG. 1.

DETAILED DESCRIPTION OF THE DISCLOSED EMBODIMENT

Figure 1:
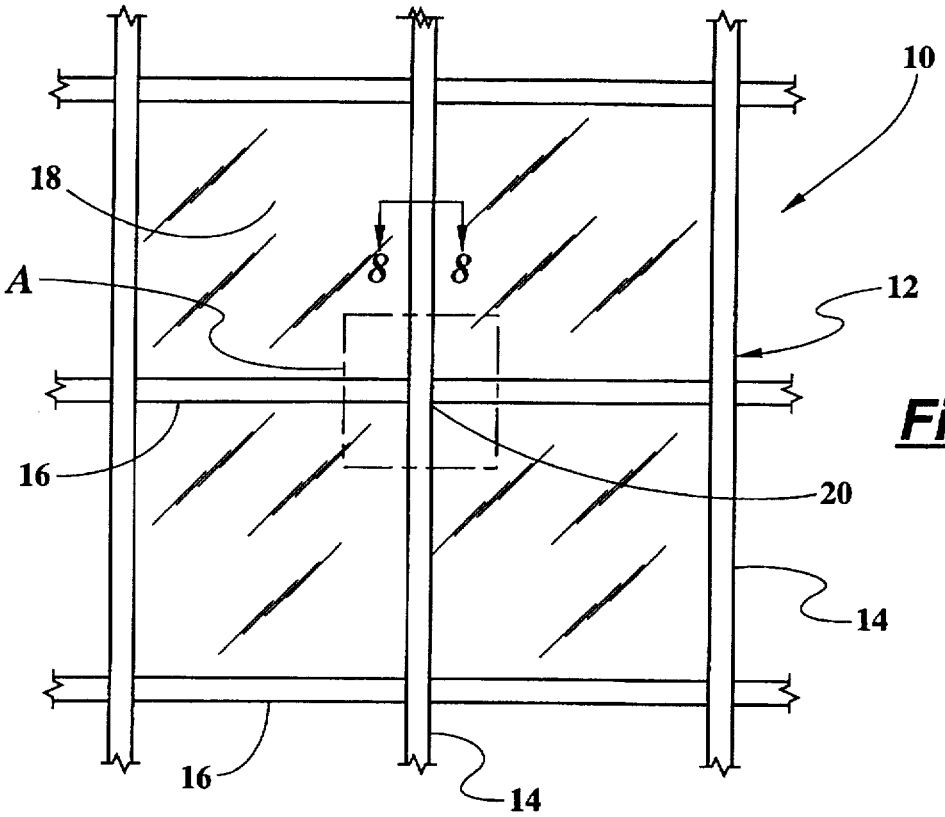
FIG. 1 is an elevation view of a section of a storefront or curtain wall framing system according to the present invention.

Referring now to the drawings, in which like numerals indicate like elements throughout the several views, FIG. 1 shows a framing system 10 comprised of a frame 12 of vertical frame members 14 and horizontal frame members 16 arranged in a grid. Infill panels such as glass lites 18 are set into the openings defined by the grid. The framing system 10 which is illustrated shows a grid defining only four openings, but it will be understood that the system can be comprised of an indeterminate number of vertical and horizontal frame members 14, 16 for mounting any number of infill panels 18. The framing system 10 illustrated in FIG. 1 is a section of a curtainwall framing system, but it will be understood that the present invention can also be incorporated into storefront framing systems and any other framing systems in which frame members are arranged to form a grid.

The vertical and horizontal frame members 14, 16 intersect at a joint 20. In the framing system 10 which is illustrated, the vertical frame member 14 extends uninterrupted through the joint 20, while horizontal frame members 16 abut both sides of the vertical frame member 14. Because the vertical frame member 14 extends "through" the joint 20 uninterrupted, it is known as a "through" frame member. Because the vertical frame members 14 of a framing system 10 normally support loads, it is usually desirable for the vertical frame members to be the "through" frame members. However, it may sometimes be desirable, for aesthetic or other reasons, for the horizontal frame members 16 to be the "through" members, and the present invention is equally applicable to both arrangements.

Figure 2:
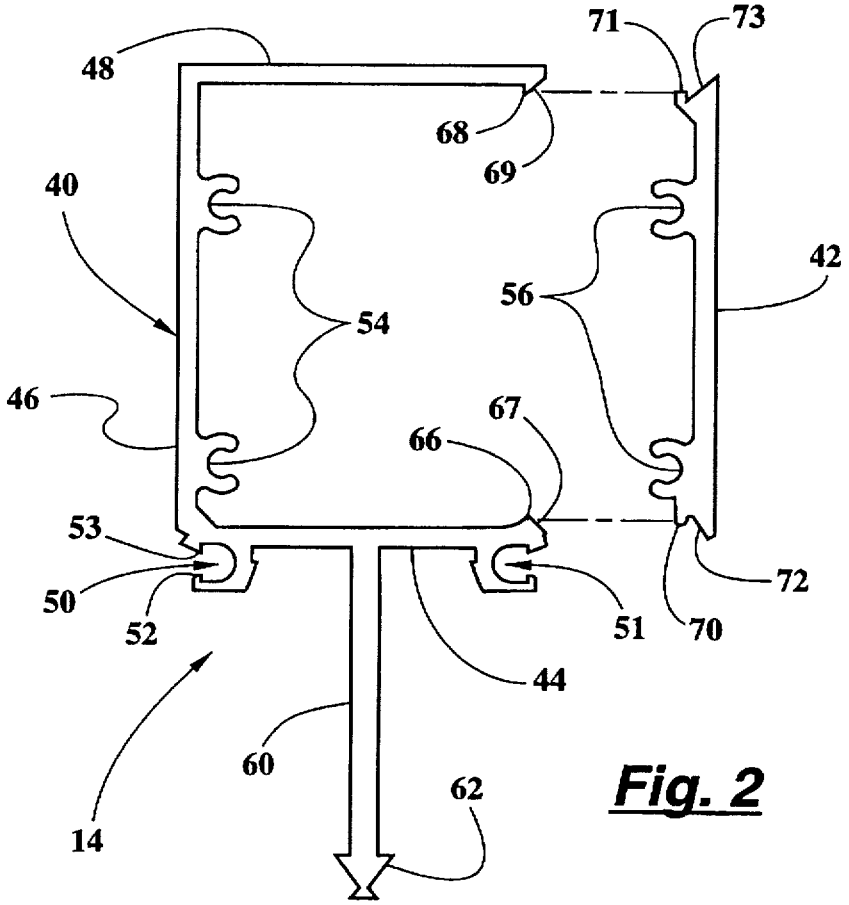
FIG. 2 is an exploded end view of one of the frame members comprising the framing system of FIG. 1.

FIG. 2 is an end view of a vertical frame member 14. The frame member 14 comprises a half mullion 40 and an associated filler 42. The half mullion 40 comprises an exterior flange 44. A side wall 46 extends rearward from the upper edge of the exterior flange 44. An interior flange 48 extends laterally from the rear edge of the side wall 46.

Weathering channels 50, 51 are formed at the lateral edges of the exterior flange 44. Inwardly extending lips 52, 53 form a narrow throat at the outer end of each of the weathering channels 50, 51.

On the interior face of the side wall 46 are a pair of screw splines 54. Similar screw splines 56 are formed on the interior face of the filler 42.

A tongue 60 projects forward from the center of the exterior flange 44. A generally triangular dart 62 is formed at the forward end of the tongue 60.

At the lateral edge of the exterior flange 44 adjacent the open side of the half mullion 40, a ridge 66 is formed. A canted edge 67 angles forward adjacent the ridge 66. A ridge 68 is also formed at the lateral edge of the interior flange 48 adjacent the open side of the half mullion 40, and a canted edge 69 angles rearward adjacent the ridge 68. Hooks 70, 71 formed at the exterior and interior ends of the filler 42 engage the ridges 66, 68 to snap the filler onto the half mullion 40. Angled edges 72, 73 at the exterior and interior ends of the filler 42 confront the canted edges 67, 69 of the half mullion 40 to prevent the filler from passing into the open side of the half mullion.

Figure 3:
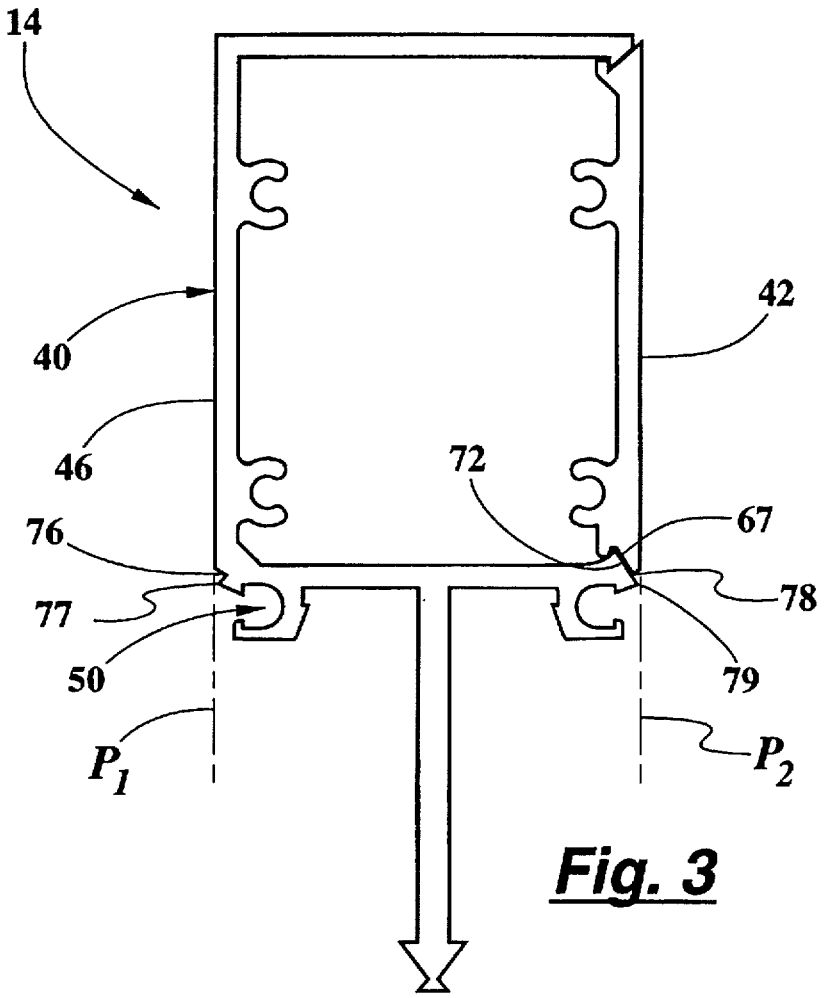
FIG. 3 is an end view of the assembled frame member of FIG. 2.

FIG. 3 shows the vertical frame member 14 with the filler 42 assembled onto the half mullion 40. On the side wall 46 of the half mullion 40 adjacent the weathering channel 50, a beveled recess 76 is formed. The crest 77 of the beveled recess 76 lies interior of a plane $P_1$ defined by the outer face of the side wall 46 of the half mullion 40.

The junction between the exterior edge 72 of the filler 42 and the canted edge 67 of the half mullion 40 forms a similar recess 78. The outermost point on the open end of the exterior flange 44 defines the crest 79 of the recess 78 and lies interior of a plane $P_2$ defined by the outer face of the filler 42.

In the framing system 10 (FIG. 1) of the disclosed embodiment, the horizontal frame members 16 are configured identically to the vertical frame members 14 just described. However, as will be explained below, it is not essential to the operation of the framing system 10 that the vertical and horizontal frame members 14, 16 be identical.

Figure 4:
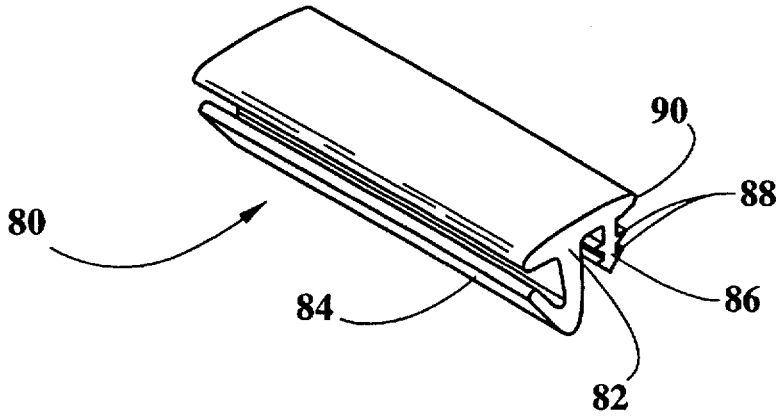
FIG. 4 is an isometric view of a weathering gasket for use in a self-sealing framing system according to the present invention.

FIG. 4 illustrates an elastomeric weathering 80. The weathering 80 comprises a body 82 with a forward-angled leg 84. A dart 86 with barbs 88 extends downward from the body 82. A lip 90 is formed at the interior end of the body 82.

Figure 6:
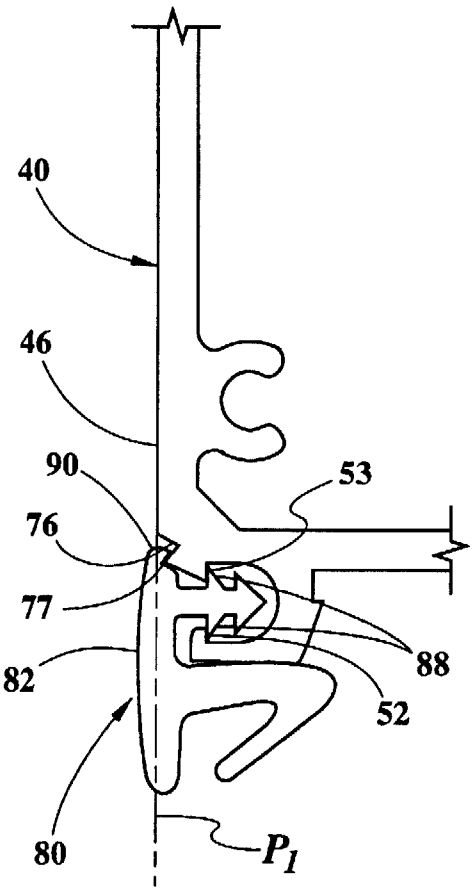
FIG. 6 shows the frame member and weathering gasket of FIG. 5 with the weathering gasket installed onto the frame member.
Figure 5:
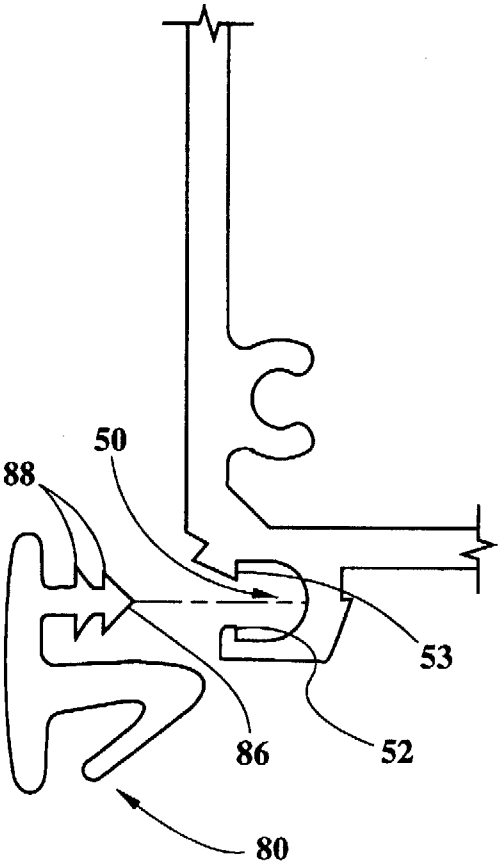
FIG. 5 is an end view of a section of the frame member of FIG. 2 with the weathering gasket of FIG. 4 exploded away from the frame member.

Referring now to FIGS. 5 and 6, the weathering 80 is installed into the weathering channel 50 of the vertical frame member 14. The dart 86 of the weathering 80 is advanced into the channel 50. The barbs 88 hook behind the lips 52, 53 at the outer end of the weathering channel 50 to anchor the weathering within the channel 50. With the weathering thus installed, the body 82 of the weathering 80 extends beyond the plane $P_1$ defined by the outer face of the side wall 46 of the half mullion 40. Also, the exterior lip 90 of the weathering 80 rests against the crest 77 of the beveled recess 76 in the side wall 46 of the half mullion 40.

Another weathering 80 is installed in the opposite weathering channel 51 in the same manner. Also in the same manner, weathering strips are installed into the weathering channels of horizontal frame members 16.

Figure 7:
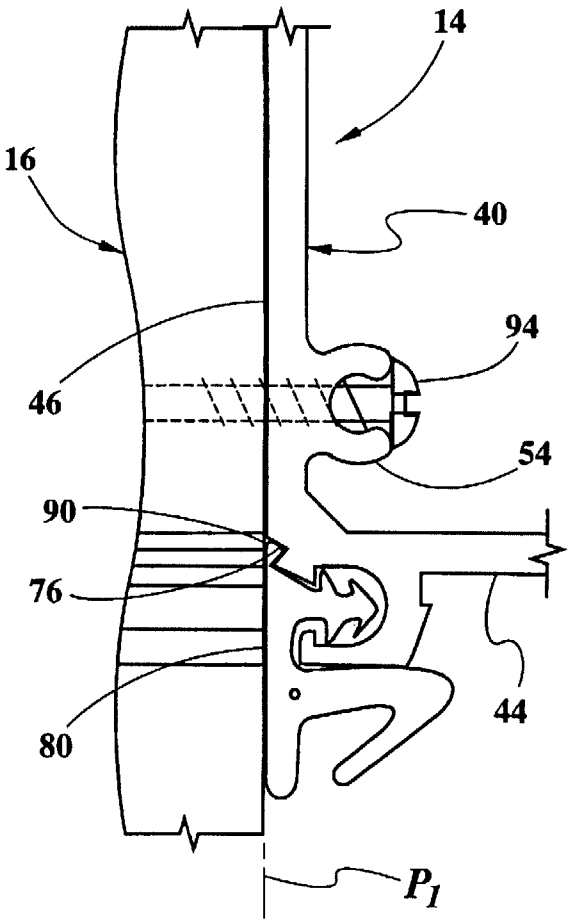
FIG. 7 shows the assembled frame member and weathering gasket of FIG. 6 with a second frame member abutting the side wall of the first frame member.

Assembly of horizontal and vertical frame members 14, 16 to form a grid 12 will now be described. Referring now to FIGS. 7 and 8, the end of a first horizontal frame member 16 is abutted against the side wall 46 of the half mullion 40 of a vertical frame member 14. Screws 94 are installed transversely through the screw splines 54 in the side wall 46 of the half mullion 40 and then longitudinally into the corresponding screw spines 54, 56 in the horizontal frame member 16. As the screws are tightened to draw the end of the horizontal frame member 16 snugly against the side wall 46 of the half mullion 40, the exterior flange 44 of the horizontal frame member 16 deforms the weathering 80 installed in the weathering channel 50 of the half mullion. As the weathering 80 is deformed, the exterior lip 90 of the weathering is displaced into the beveled recess 76 in the side wall 46 of the half mullion. In addition, along the line at which the exterior flange 44 of the horizontal frame member 16 contacts the weathering gasket 80, the gasket is displaced so that it lies entirely on one side of the plane $P_1$ defined by the outer face of the side wall 46 of the vertical frame member 14.

Similarly, in an assembly sequence which is not shown, the end of a second horizontal frame member 16 is abutted against a filler 42, and screws 94 are installed through the screw splines 56 in the filler 42 and into the screw splines 54, 56 in the second horizontal frame member 16. The screws are tightened to draw the end of the horizontal frame member 16 snugly against the filler 42.

The filler 42 with horizontal frame member 16 fastened to it is now assembled onto the open side of the half mullion 40. The hooks 70, 71 formed at the exterior and interior ends of the filler 42 snap behind the ridges 66, 68 of the half mullion 40 to connect the filler and half mullion. As the filler 42 is assembled onto the half mullion 40, the front flange 44 of the horizontal frame member 16 attached to the filler deforms the weathering 80 installed in the weathering channel 51 of the half mullion. The exterior lip 90 of the weathering 80 is displaced into the beveled recess 78 defined by the angled exterior edge 72 of the filler 40. In addition, along the line at which the exterior flange 44 of the horizontal frame member 16 contacts the weathering gasket 80, the gasket is displaced so that it lies entirely on one side of the plane $P_2$ defined by the outer face of the filler 42 of the vertical frame member 14.

Figure 10:
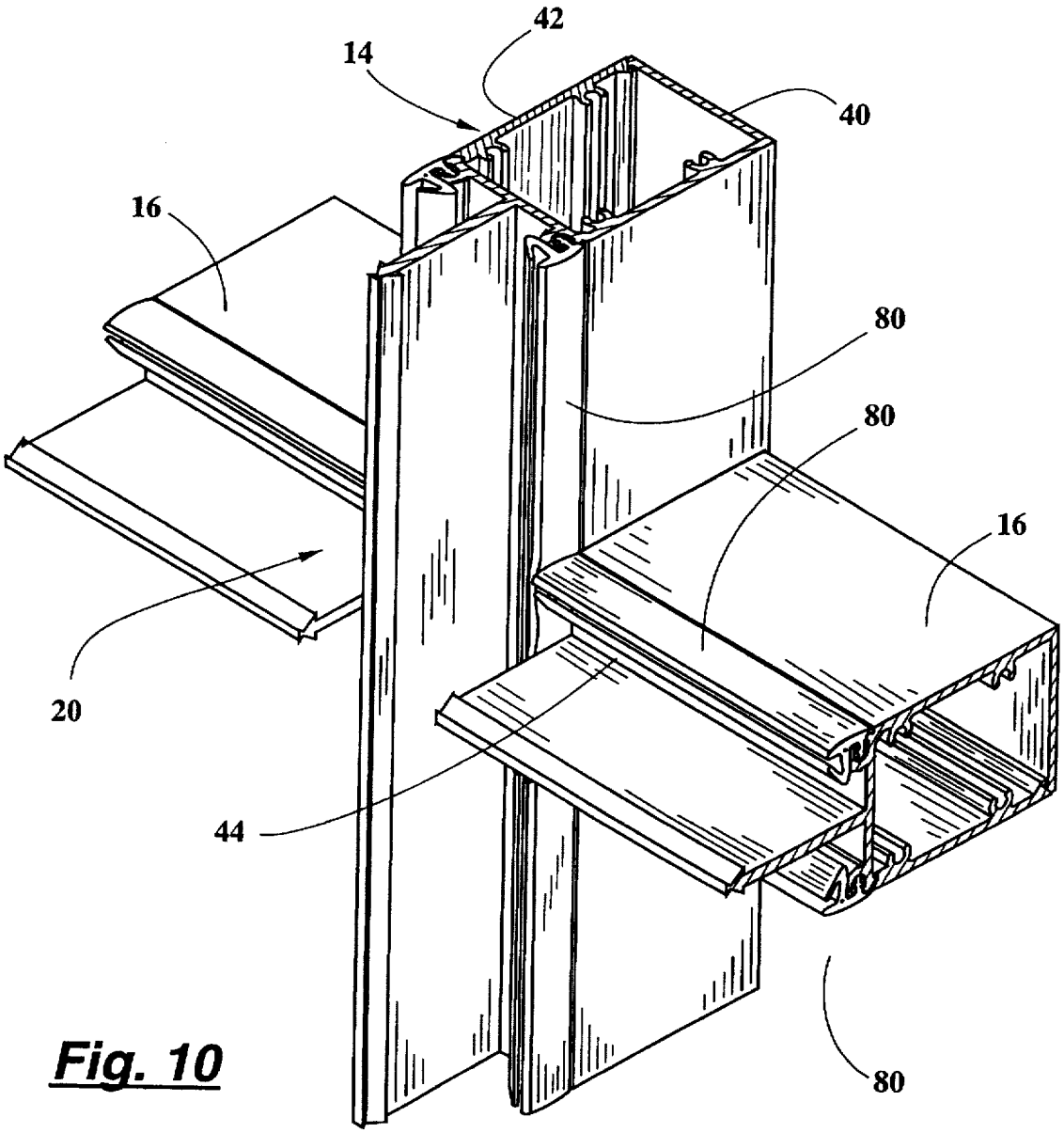
FIG. 10 is an isometric view of the joint identified by the rectangle A in FIG. 1.

FIGS. 9 and 10 show an assembled joint 20. The continuous, uninterrupted contact of the exterior flanges 44 of the horizontal frame members 16 pinches the resilient elastomeric weathering 80 to create a continuous seal through the joint 20.

With the frame 12 thus erected, the remaining steps in the assembly of the framing system 10 are conventional. Setting blocks (not shown) are placed on the upper surface of the tongues 60 of the horizontal frame members 16, and glass lites 18 are set on the setting blocks. The forward-angled legs 84 of the weathering 80 bear against the interior marginal portion of the glass lites. Snap-on cover members (not shown) with exterior glazing gaskets mounted thereto snap onto the darts 62 at the forward edges of the tongues 60 of the frame members 14, 16.

The framing system 10 of the present invention provides a number of advantages over prior art framing systems. First, the system is self-sealing, creating a water and air seal through the joint 20 without the need for applying a sealant. Stated differently, when the glazing gasket is installed the joint seal is also installed at the same time. As a result, the system 10 is easier and less labor intensive to erect. Also costly joint seals and clean-up are not required. In addition, the possibility of leaks resulting from improper application of sealant by unskilled labor is avoided.

Second, because the weathering is held in place by the assembled joints, the system can be shipped with the weathering installed without it becoming disengaged from its weathering channel. Another benefit of the weathering being held in place by the assembled joints is that the frame can be racked during installation without breaking the seals.

As previously suggested, while the disclosed framing system 10 comprises identically-configured vertical and horizontal frame members 14, 16, it is not necessary that the verticals and horizontals be identically configured. The important considerations are that the through frame member (in this case, the vertical frame member 14) include the continuous weathering, a portion of which overlies a recess into which the weathering can be displaced when deformed; and that the intersecting frame member (in this case, the horizontal frame member 16) have a web which confronts the weathering and deforms it when the joint is assembled. Within these parameters, the vertical and horizontal frame members can be of different configurations, and either the vertical or the horizontal frame member can be the "through" frame member.

Finally, it will be understood that the preferred embodiment has been disclosed by way of example, and that other modifications may occur to those skilled in the art without departing from the scope and spirit of the appended claims.

What is claimed is:

1. A framing system comprising:

a first frame member having a side wall, said side wall defining a plane;

a recess defined in said side wall of said first frame member;

an elastomeric weathering gasket mounted to said first frame member such that a portion of said weathering gasket overlies said recess, said elastomeric weathering gasket in an undeformed condition normally extending through said plane defined by said side wall of said first frame member; and a second frame member oriented substantially perpendicular to said first frame member and having an end abutting said side wall of said first frame member, said end of said second frame member contacting said elastomeric weathering gasket along a line of contact, said weathering gasket along said line of contact being displaced onto one side of said plane by said contact with said end of said second frame member, and a portion of said weathering gasket being displaced into said recess in said side wall of said first frame member;

whereby said weathering gasket forms a continuous seal between said first and second frame members along said line of contact.

2. The framing system of claim 1, wherein said first frame member further comprises a weathering channel, and wherein said elastomeric weathering gasket engages said weathering channel to mount said weathering gasket to said first frame member.

3. The framing system of claim 2, wherein said recess defined in said side wall of said first frame member comprises a beveled recess formed adjacent said weathering channel.

4. The framing system of claim 3, wherein said beveled recess angles into said side wall of said first frame member and away from said weathering channel.

5. The framing system of claim 1, wherein said side wall of said first frame member comprises a first side wall, wherein said first frame member further comprises a second side wall opposite said first side wall and having a recess defined therein, wherein said elastomeric gasket comprises a first elastomeric gasket, and wherein said framing system further comprises:

a second elastomeric gasket mounted to said first frame member such that a portion of said second weathering gasket overlies said recess in said second side wall, said second elastomeric weathering gasket in an undeformed condition extending through a plane defined by said second side wall of said first frame member; and a third frame member oriented substantially perpendicular to said first frame member and having an end abutting said side wall of said first frame member, said end of said third frame member contacting said second elastomeric weathering gasket along a second line of contact, said second weathering gasket along said second line of contact being displaced onto one side of said plane defined by said second side wall of said first frame member by said contact with said end of said third frame member, and a portion of said second weathering gasket being displaced into said recess in said second side wall of said first frame member.

6. The framing system of claim 5, wherein said second side wall of said first frame member comprises a filler attached to said first frame member.

* * * * *